United States Patent [19]

Johnson, Jr. et al.

[11] Patent Number: 4,763,462

[45] Date of Patent: Aug. 16, 1988

[54] METHOD FOR INSERTING PARTITIONS

[75] Inventors: A. David Johnson, Jr.; Joseph L. Bachman, Jr., both of Wayne, Pa.

[73] Assignee: Wayne Automation Corp., Norristown, Pa.

[21] Appl. No.: 923,100

[22] Filed: Oct. 24, 1986

[51] Int. Cl.[4] ..... B65B 35/44

[52] U.S. Cl. ..... 53/448; 53/263; 493/91; 493/312

[58] Field of Search ..... 53/263, 448, 158, 543, 53/564; 493/391, 312, 912, 91

[56] References Cited

U.S. PATENT DOCUMENTS

| | | | |
|---|---|---|---|
| 3,473,295 | 10/1969 | Nigrelli et al. | 493/391 X |
| 3,698,151 | 10/1972 | Arneson | 53/448 X |
| 3,805,476 | 4/1974 | Kawamura et al. | 53/448 |
| 3,848,519 | 11/1974 | Ganz | 493/312 |

*Primary Examiner*—James F. Coan

*Attorney, Agent, or Firm*—Frederick J. Olsson

[57] ABSTRACT

In an integrated container packing system where a mass of randomly oriented containers enter the system and are manipulated so that a partition can be inserted between groups of containers and then each group with the partition are placed in a shipping medium ready to be sent to inventory, the method of inserting the partition by relatively moving the containers and the partition in a forward direction, controlling the relative motion so that in alternately occurring periods of time, the velocity of the relative motion during one period of time is zero and during the next period of time the velocity of the relative motion gradually increases from zero to a maximum and then gradually back to zero and during each time the relative motion velocity is at zero, inserting the partition between a group of containers.

6 Claims, 1 Drawing Sheet

METHOD FOR INSERTING PARTITIONS

This invention relates in general to packing containers such as glass, metal, plastic, paper, and the like in a shipping medium particularly where the packaging specification requires partition means between the containers.

More specifically, the invention relates to a method for inserting partitions in an integrated system, that is to say, a system wherein containers are fed along an axis, partition means are successively inserted between containers and then the containers and partition means are fed to an operation wherein the same are placed in a shipping medium.

Systems of the kind mentioned which employ abrupt stopping and restarting of the containers for the partition insert operation have a disadvantage because high speed is impractical for use with the fragile containers due to the fact that the momentum of the containers on an abrupt stop causes distortion or breakage at a rate which is unacceptably high.

Systems of the kind mentioned which do employ high speed without abrupt stopping and restarting have the disadvantage of requiring essentially perfect timing to insert the partition means between containers. Thus, such systems are limited to use with long-neck type bottles and to jars with heads and caps of reduced diameter and further must use a multi-stage partition insert operation; i.e. the partition is inserted piece-by-piece as the containers move down the line.

The invention contemplates a partition insertion method for an integrated continuous system wherein a partition means is inserted between containers when the relative forward velocity between the containers and the partition means is zero. The method provides for relatively moving the containers and partition means in a forward direction and controlling the relative motion so that in alternately occurring periods of time the velocity of relative motion during one period of time is zero and during the next period of time the velocity of relative motion gradually increases from zero to a maximum and thence gradually back to zero and during each time the relative velocity is at zero inserting partition means between containers.

The above method as applied to such systems permits the system to be operated at a relatively high speed on any type of container, without container distortion or breakage, with any type of partition, without partition hang-up, and with a single stage insert operation.

Figure 1:
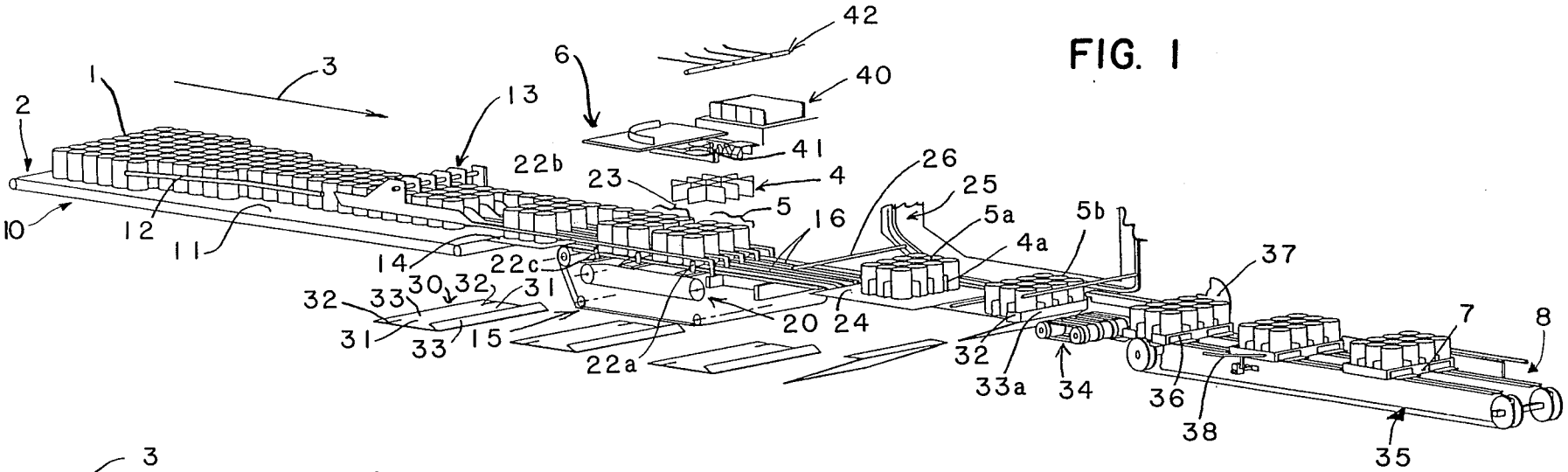
Figure 3:
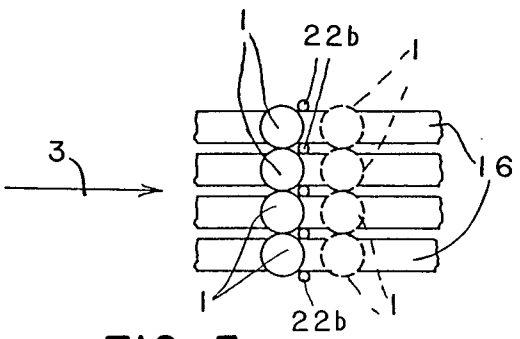
Figure 2:
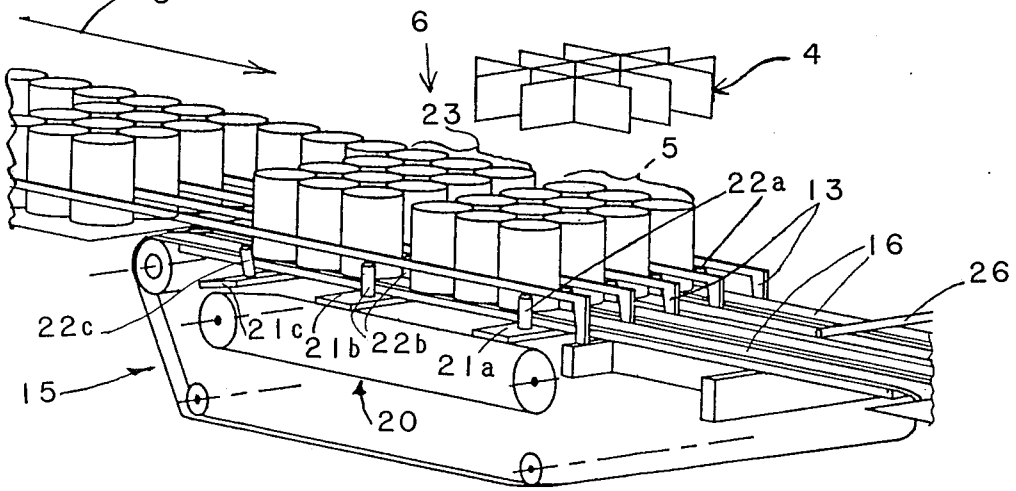

The method will be described below in connection with the following drawings wherein:

FIG. 1 is a perspective view of integrated-type equipment arranged to operate in accordance with the method; and FIG. 2 is an enlarged, fragmentary view of the insert station area of the system of FIG. 1; and FIG. 3 is an enlarged, fragmentary plan view illustrating grouper pins inserted between containers.

FIG. 1 illustrates an example of an integrated, continuous container packing system wherein a mass of individual containers 1 enters the end 2, are arranged and moved in a forward direction (arrow 3) so that a partition means such as shown at 4 is inserted between a small group 5 of containers. This takes place at an insert station generally indicated at 6. After the insert, the group and partition means are fed to an operation wherein the same are placed in a shipping carton such as tray 7 and then the finished package exits at end 8 to be placed in inventory. As will be apparent, the containers move in the forward direction along a horizontal axis.

As previously indicated, the invention deals with the method by which the partitions are inserted. Before explaining the method, we will first describe the various components of the system of FIG. 1.

An infeed conveyor of conventional form is noted at 10. The conveyor includes the movable horizontally oriented belt 11 which supports the containers. The belt 11 makes a frictional engagement with the bottoms of the containers and moves the same in the forward direction. Over the belt 11 are container guides, one of which is noted at 12. The container guides 12 arrange the containers in a funnel shape and direct the containers into the lane guide means 13.

The lane guides 13 place the entering containers in a plurality of lanes which are parallel one another and extend along the horizontal axis. In the representation of FIG. 1 some of the containers in the lanes have been omitted for purposes of showing the lane guides.

The containers in the respective lanes are shown as in side-by-side and in an engaging relationship. The containers are also aligned, side-by-side, in a plurality of rows which are normal to the lanes. As in the rows, the containers do not engage since they are separated by the lane guides. The foregoing is the condition of the containers after the equipment has begun to insert partitions.

From the belt 11, the leading containers are pushed (by the trailing containers) onto the dead plate 14.

Forward of the dead plate 14 is a grouper belt conveyor 15 having a plurality of belts 16 (corresponding to the number of lanes) which are driven in unison. Preferably, the belts 11 and the belts 16 are driven at the same linear speed. The belts 16 make a frictional engagement with the bottoms of the containers and move same in the forward direction.

With respect to the above mentioned frictional engagement between the bottoms of the containers, and the belts 11 and 16, the engagement not only has a driving function, but in addition, has a slipping function. As will be pointed out later, at certain periods of time the containers are restrained from being moved forward by the belts and when this condition occurs, the slippage function provides for the belts to continually move relative to the containers.

Inside of the grouper belt conveyor 15 is a grouper pin conveyor 20 which carries a plurality of sets of grouper pins. The sets shown are labelled 21*a*, 21*b*, and 21*c*, and the corresponding pins are labelled 22*a*, 22*b*, and 22*c*. The grouper pins 22*a* of the set 21*a* on the forward side of the containers are adapted to be engaged with the containers and restrain motion of the containers in the forward direction. It is preferable that a container be engaged by two grouper pins. Thus, with four containers in a transverse row, there are five grouper pins as is indicated in FIGS. 1 and 3 at 22*b*. As noted, the, inside grouper pins 22*b* are located between the belts 16. The containers 1 in full lines will be restrained by the pins 22*b*.

In the embodiment shown, the grouper pin conveyor carries five sets of grouper pins, two sets of which are not shown. The sets move in unison, around the conveyor profile; i.e. along the top, around the forward end, backwards along the bottom, and thence around the trailing end to the top. When a set moves around the trailing end, the pins move upward between two adjacent rows of containers and function to separate the adjacent rows. This is indicated in FIG. 3 by the spaced-apart containers 1 in full and dotted lines. Thus, the engagement of adjacent, spaced-apart sets of grouper pins with the pins of each set between adjacent rows of containers forms the containers into separated groups. Note the separation of groups 5 and 23 in FIGS. 1 and 2.

As shown, the first group 5 comprises three containers in each lane and four containers in each row. The second group 23 has identically arranged containers. The group 5 is in a position for the insertion of a partition and the group 23 is ready to be moved into the insert position.

A set of grouper pins 22*a* moving from the top around the leading end of the conveyor 15 will be disengaged from the containers of group 5 and this group will be moved by the belts 16 onto another dead plate 24 as indicated for the group 5*a*. As will be noted, the group 5*a* has the partition means 4*a* inserted between the containers.

From the dead plate 24 the group 5*a* and partition means 4*a* are delivered to means for placing the same in a shipping medium. In the particular system shown, the shipping medium is a tray, however, the shipping medium can take any of the conventional forms. The tray forming operation will now be briefly described.

A rotary flight bar conveyor 25 has flight bars 26 which engage the group 5*a* on the dead plate 24 and moves the same forward to a position indicated for the group 5*b*. In this position the group is adjacent a tray entry slot not shown.

A tray blank conveyor not shown conveys tray blanks 30 from a magazine forwardly and upwardly toward the tray entry slot. Each of the tray blanks 30 has a pair of end flaps 31 each having tabs 32 and pairs of side flaps 33. The forward side flap 33 in each blank is held in the angled position shown. The tray blank conveyor moves each tray blank through the entry slot and then the forward flap 33 is released. At that time the memory at the flap score causes the flap to assume the upright position indicated by flap 33*a*.

The foregoing motion of the tray blank conveyor and the forward motion of the flight bars are coordinated so that just after the flap 33*a* is upright, it is engaged by the group 5*b*. The group 5*b* is then further moved by a flight bar and this motion pulls the tray blank through the entry slot onto the nip roller conveyor 34.

Forward of the nip roller conveyor 34 is a carrier conveyor 35 which mounts sets of flap holders, each set having a front flap holder and a rear flap holder. The front flap holder is indicated at 36. The front and rear flap holders in each set are spaced apart a distance the same as the width of the tray.

The drive of the carrier conveyor 35 and the drive of the nip roller conveyor 34 are coordinated so that when a set of front flap holders has moved around the rear end of the conveyor 35 the leading side flap of the tray blank engages the front flap holder and is oriented vertically up against the containers and as motion continues the rear flap holder engages the rear flap which is then oriented vertically up against the containers.

As motion continues,the tabs 32 (while the flaps 31 remain horizontal) are pushed inwardly by plows not shown. Glue is then applied to the flaps 31 and flap tucker means turns the flaps upwardly to engage the tabs 32. One of the flap tucker means is shown at 37. As the tray continues to be moved by the carrier conveyor 35, static flap folders push the flaps 31 up tight against the tabs 32. One of the static flap folders is shown at 38. The formation of the tray is now complete and carrier 35 moves the same to a pick-up position.

Referring back to the insert station 6, we will now briefly describe mechanism at this station.

A magazine 40 holds a plurality of flat, folded partitions in ready condition to be taken out. The take-out is accomplished by a mechanism carrying suction cups which moves the cups up against the lead partition and pulls the partition back through an arc to a point over the alignment grid 41. During the pull-back the partition is opened. A rake 42 is used to engage and push the partition down through the alignment grid and on down between the containers in group 5.

We will now describe the method for inserting partitions.

The providing of an integrated system to be operated at relatively high speed on any type of container, without container distortion or breakage, with any type of partition, and without partition hang-up, involves the concept of causing the relative forward velocity between the partitions and the containers to be zero during the time the partition is inserted. In other words, there is a finite period during which the partition is brought into contact with the containers and pushed between same. So long as there is space between the containers or space into which the containers can be shifted, the top shape of the container becomes irrelevant and any timing factor is eliminated. In achieving the foregoing, the system provides that the relative displacement/time relationship or velocity is in the form of a half wave; i.e. the velocity of the relative motion during one period of time is zero and then in the next period the velocity is made to gradually increase from zero to a maximum and thence gradually decrease back to zero.

The foregoing is achieved in the embodiment shown by fixing the velocity of the partition in the forward direction at zero and then causing all of the containers from the insert station back to the entrance end 2 to move inthe half-wave fashion.

This is done by capturing a group of containers between adjacent sets of pins for example the group 23, and restraining the foreward motion of the group by controlling the rotation of the grouper pin conveyor 20. For purposes of the discussion below, assume that no group is forward of group 23.

With the conveyor 20 stopped, the pins 22*b* will prevent the containers in group 23 from moving in the forward direction. The pins 22*c* will prevent all of the containers back to entrance end 2 from moving in the forward direction.

The group 23 is held at zero velocity for a fraction of a package cycle. During this time, the frictional engagements between the containers on belt 11 and belts 16 permit the on belts to continue their respective forward motions.

When the zero time period has ended, the grouper pin conveyor 20 is driven so that the linear velocity of the pins 22*b* and 22*c* goes from zero gradually to a maximum and then gradually back to zero. This motion places the group 23 in the insert station; i.e. in the same position as shown for group 5. During the zero velocity period the partition in inserted.

During the motion just described, it will be evident that another set of pins will have gone around the rear end of the grouper pin conveyor 20 and these pins slipped between adjacent rows of containers to form another group which is in the ready position to be moved to the insert position (like group 23 is in ready condition as shown in FIGS. 1 and 2)

It will be evident that during the time the partition is being inserted, the pins (such as pins 22*b* and 22*c*) by restraining all of the containers back to the entrance end 2 eliminates any forward pressure on the group in the insert station. This freedom from forward pressure eliminates jam-up of containers in the group which could make partition insertion impossible.

The spacing between adjacent sets of pins (such as between the pins 22*a* and 22*b*) is slightly greater than the composite width (taken along a lane) of the containers in the group. In this way, there is freedom for the containers to be slightly shifted by the partition if the containers happen to be engaged. In the various rows, the containers are separated by the lane guides 13 so there is no interference in the transverse direction.

When a partition is pushed down between the containers by the rake 42, the motion stops when the bottom of the partition reaches the top edges of the lane guides 13. When the group of containers with the partition is moved away from the insert station by belts 16, the partition simply slides down between the containers until engaging the belts 16. Mechanical means to insert sliding may be provided.

We claim:

1. The method of inserting partition means between containers successively brought into a position for such insertion comprising the steps of:

providing a supply of partition means;

providing a supply of containers aligned in lanes and aligned in transverse rows;

providing conveyor means for supporting the containers and having frictional engagement with the bottoms of containers for moving the same and the conveyor means being movable along a horizontal axis;

providing a plurality of spaced apart sets of restraining means to be inserted between adjacent rows of containers, the restraining means being movable along said axis and functioning to restrain the containers from being moved along said axis by said conveyor means and said frictional engagement with said containers providing for slippage when the containers are restrained by said restraining means whereby the conveyor means moves relative to the containers;

successively inserting a plurality of sets of restraining means between adjacent rows of containers including at least a leading set and a lagging set of spaced apart restraining means respectively between adjacent rows of containers, the leading and lagging sets conditioning the containers therebetween for the inserting of a partition and the lagging set preventing the supply containers from exerting pressure on the containers between the sets;

each time the leading and lagging sets are so inserted, moving the restraining means from zero velocity to a maximum velocity and thence to zero velocity so that the containers between the leading and lagging sets partake of the same motion and the containers rearward of the lagging set being driven by the conveyor means and restrained by the lagging set also partake of the same motion;

each time the containers between the leading and lagging sets are at zero velocity inserting a partition therebetween; and during the time the restraining means moves from zero velocity:

(a) the leading set disengaging from and releasing the containers and partition therebetween so the same are moved by said conveyor means for delivery to an operation wherein the containers and partition means are placed in shipping medium;

(b) the said lagging set assumes said function of first said leading set; and (c) another set of restraining means is inserted between adjacent rows of containers and assumes said function of first said lagging set.

2. The method of inserting partition means between containers successively brought into a position for such insertion comprising the steps of:

providing a supply of partition means;

providing a supply of containers aligned in lanes and aligned in transverse rows with lead containers thereof to receive partition means;

providing conveyor means for supporting the supply containers and the lead containers and having frictional engagement with the bottoms of containers for moving the containers and the conveyor means being movable in a forward direction along a horizontal axis;

providing restraining means to engage lead containers and engage supply containers, the restraining means functioning to restrain the containers from being moved along said axis by said conveyor means;

establishing a condition wherein the restraining means has engaged lead containers and supply containers and has zero velocity so that the lead containers and the supply containers also have zero velocity, the frictional engagement between the conveyor means and the containers thereon providing slippage whereby the conveyor means moves relative to the supply containers and lead containers;

moving the restraining means to cause the lead containers to move from said zero velocity to a maximum velocity and then to zero velocity wherein the lead containers are positioned for insertion of partition means, the slippage engagement between the conveyor means and the lead containers providing for the conveyor means to move relative to the lead containers while the restraining means moves the lead containers as aforesaid;

said movement of the restraining means and the driving and slippage engagement between the conveyor means and the supply containers causing the supply containers to follow said motion of the lead containers and also providing for the conveyor means to move relative to the supply containers;

during each time the lead containers are at zero velocity inserting a partition therebetween; and after each said partition is inserted, causing said restraining means to permit the lead containers to be moved by said conveyor means for delivery to an operation wherein the group and partition means are placed in a shipping medium.

3. The method of inserting partition means between containers in groups of containers which groups are successively brought into a position for such insertion comprising the steps of:

providing a supply of containers;

providing a supply of partition means at an insert station wherein the partition means are to be inserted in a group of containers;

causing relative motion between the supply of containers and the supply of partition means in a forward direction along a horizontal axis and during such motion segregating said supply containers into a group of containers;

after the forming of the group, causing said relative motion in said forward direction to be zero;

each time the forward relative motion is zero, inserting partition means between containers of a group; and after each said insertion moving the group and partition therein for delivery to an operation wherein the group and partition means are placed in a shipping medium.

4. The method of inserting partition means between containers in groups of containers which groups are successively brought into a position for such insertion comprising the steps of:

providing a supply of containers;

providing a supply of partition means at an insert station wherein the partition means are to be inserted respectively in groups of containers sequentially moved into the insert station;

providing conveyor means moving at a forward velocity along a horizontal axis to move supply containers adjacent said insert station and to move a group of containers with partition means inserted therein away from said insert station and providing for the conveyor means to have a frictional engagement with the bottoms of containers thereon;

providing grouper means operable to capture a plurality of supply containers to form a group and control the forward velocity of the captured group which is lower than the forward velocity of the conveyor means and simultaneously control the forward velocity of the supply containers at a level the same as the velocity of the group whereby the supply containers and the group move together and with the group moving into the insert station wherein the forward velocities of the group and the supply containers are both zero and operable after insertion to release the group to permit the same to be moved by said conveyor means, said frictional engagement providing for slippage between the conveyor means and containers thereon when the grouper means causes said lower velocities whereby the conveyor means continues to move relative to the containers thereon arranging a plurality of supply containers on said conveyor means in a plurality of lanes which are parallel to one another and which extend along said horizontal axis and, as arranged in said lanes, disposing the supply containers side-by-side in a plurality of rows transverse to the lanes;

using said conveyor means to move said plurality of supply containers along said horizontal axis toward said partition insert station;

when the containers are adjacent said insert station using said grouper means to capture a plurality of supply containers to form a group and move the supply containers and the group so the group moves into said insert station wherein the forward velocities of the group and the supply containers are both zero and using said grouper means to simultaneously capture a plurality of supply containers to form a second group and position the second group for subsequent movement into said insert station;

during the time the first group has zero velocity, inserting partition means between the containers of the first group;

after said partition means has been inserted, operating the grouper means:

(a) to release the first group and the partition means therein to permit the same to be moved by said conveyor means for delivery to an operation wherein the group and the partition means are placed in a shipping medium;

(b) to simultaneously move said supply containers and said second group into said insert station wherein the velocities of the second group and supply containers are both zero; and (c) to simultaneously capture a third group of containers and position the same for movement into the insert station; and during the time the second group has zero velocity, inserting partition means between containers of the group.

5. The method of inserting partition means between containers in groups of containers which groups are successively brought into a position for such insertion comprising the steps of:

providing conveyor means to move supply containers along a horizontal axis up to an insert station for the insertion of partition means between containers in a group of containers and after insertion to move the group of containers with the inserted partition means away from the insert station;

providing for the conveyor means to have frictional engagement with the bottoms of containers thereon, said engagement functioning alternatively for the conveyor means to move along the horizontal axis relative to containers thereon or to move containers thereon at a forward velocity along the horizontal axis;

arranging a plurality of supply containers on said conveyor means side-by-side in a plurality of lanes which are parallel to one another and which extend along said horizontal axis and, as arranged in said lanes, disposing the supply containers side-by-side in a plurality of rows which are transverse to the lanes;

providing a plurality of sets of grouper pins, the sets being equally spaced apart in a direction along said horizontal axis and movable in unison at a velocity less than the forward velocity of the conveyor means and by said motion being positionable between containers in adjacent rows and when a pair of adjacent sets are so positioned, the containers in the space between the sets constituting a group of containers with the distance between the adjacent sets being greater than the composite width of the containers in the group, the width being taken in a lane to provide space for inserting a partition;

by using said conveyor means, moving said plurality of containers along said horizontal axis toward said partition insert station and prior to the time the containers reach said station moving said sets of grouper pins:

(a) to position first and second adjacent sets between and engaged with containers in adjacent rows to form a first group of containers, the second set also engaging adjacent supply containers and said first and second sets by being respectively engaged with containers of the first group and being engaged with supply containers controlling the forward velocities of the group and the supply containers;

(b) to further move the sets of grouper pins to move the first group and the supply containers toward said insert station and have zero velocities when the first group is in the insert station with the first group being positioned for insertion of the partition means; and (c) to cause a third set to be positioned between and engaged with containers in other adjacent rows to form a second group;

said frictional engagement with said containers providing for slippage whereby the conveyor means continues to move at said forward velocity when the velocities of the supply and group containers are being brought to and when at zero;

during the time first said group has zero velocity, inserting partition means between containes of the first group;

after said partition means has been inserted, moving said sets:

(a) to cause the disengagement of the first set with containers of the first group to permit the first group and the partition means therein to be moved by the conveyor means for delivery to an operation wherein the first group and partition means are placed in a shipping medium;

(b) to move the second group and the supply containers toward said insert station for the second set to have zero velocity in the insert station with second group positioned for insertion of the partition means; and (c) to cause a third set to be positioned between partition means and engaged with containers in other adjacent rows; and during the time said second group has zero velocity, inserting partition means between containers of the second group.

6. In an integrated container packing system wherein a mass of randomly oriented containers enter the system and are manipulated for partition means to be inserted between groups of containers and then each group placed in a shipping medium ready to be sent to inventory, the method of inserting the partition means comprising:

providing containers and partition means;

providing for relatively moving the containers and the partition means in a forward direction;

controlling said relative motion so that in alternately occurring periods of time, the velocity of the relative motion during one period of time is zero and during the next period of time the velocity of the relative motion gradually increases from zero to a maximum and thence gradually back to zero; and during each time said relative motion velocity is at zero, inserting partition means between containers.

* * * * *